US009111465B2

(12) United States Patent
Farell

(10) Patent No.: US 9,111,465 B2
(45) Date of Patent: Aug. 18, 2015

(54) STYLIZED HANGING GIFT TAG

(71) Applicant: Cecilia Farell, Orlando, FL (US)

(72) Inventor: Cecilia Farell, Orlando, FL (US)

( * ) Notice: Subject to any disclaimer, the term of this patent is extended or adjusted under 35 U.S.C. 154(b) by 58 days.

(21) Appl. No.: 14/082,822

(22) Filed: Nov. 18, 2013

(65) Prior Publication Data

US 2015/0135570 A1 May 21, 2015

(51) Int. Cl.

| | |
|---|---|
| ***G09F 3/02*** | (2006.01) |
| ***G09F 3/04*** | (2006.01) |
| ***G09F 23/00*** | (2006.01) |

(52) U.S. Cl.

CPC .. *G09F 3/02* (2013.01); *G09F 3/04* (2013.01); *G09F 23/00* (2013.01); *G09F 2003/0273* (2013.01)

(58) Field of Classification Search

CPC ..... G09F 2003/0266; G09F 2003/0273; G09F 3/14

See application file for complete search history.

(56) References Cited

U.S. PATENT DOCUMENTS

| | | | | | |
|---|---|---|---|---|---|
| 316,773 | A * | 4/1885 | Goodwin | 40/665 |
| 2,625,131 | A * | 1/1953 | Sturhahn | 116/308 |
| 3,662,480 | A * | 5/1972 | Gilson et al. | 40/663 |
| 4,556,588 | A * | 12/1985 | Rockwood | 428/13 |
| 6,220,010 | B1 * | 4/2001 | Gomez | 59/80 |
| 2002/0083629 | A1 * | 7/2002 | Skapyak et al. | 40/310 |
| 2003/0226298 | A1 * | 12/2003 | Bjork | 40/310 |
| 2005/0000135 | A1 * | 1/2005 | Trigger | 40/664 |
| 2005/0257410 | A1 * | 11/2005 | Horowitz et al. | 40/665 |
| 2006/0207132 | A1 * | 9/2006 | Vaughan et al. | 40/310 |
| 2007/0160246 | A1 * | 7/2007 | Vollmer | 381/336 |
| 2008/0210586 | A1 * | 9/2008 | Didio | 206/457 |
| 2009/0015000 | A1 * | 1/2009 | Wolfe | 283/74 |
| 2010/0236119 | A1 * | 9/2010 | Pellei | 40/638 |
| 2012/0255882 | A1 * | 10/2012 | Glass | 206/232 |
| 2014/0007477 | A1 * | 1/2014 | Berger et al. | 40/665 |

* cited by examiner

*Primary Examiner* — Gary Hoge

(74) *Attorney, Agent, or Firm* — Jason T. Daniel, Esq.; Daniel Law Offices, P.A.

(57) ABSTRACT

A stylized hanging gift tag includes a decorative main body that is adorned with indicia having a plurality of shapes, colors, patterns and at least one celebratory message. An elongated tether is secured to the top end of the main body and terminates into an expandable bottle attachment loop. A decorative chain is disposed along the back side of the main body and is attached at either end to the sides of the main body.

11 Claims, 8 Drawing Sheets

STYLIZED HANGING GIFT TAG

TECHNICAL FIELD

The present invention relates generally to hanging tags, and more particularly to a stylized gift tag conveying a celebratory message which can be hung from a bottle or other such device having an elongated neck.

BACKGROUND

The statements in this section merely provide background information related to the present disclosure and may not constitute prior art.

Gift giving is a year round occurrence, and one of the most popular gifts exchanged between adults is alcohol. Whether it is a bottle of wine, champagne, liquor or beer, nothing conveys friendship, love or concern better than a good bottle of spirits. In this regard, gifts are typically accompanied by a personal message from the gift giver, which most often consists of conventional greeting cards having pre-printed celebratory messages.

Although satisfactory for use with gifts that are enclosed within a protective outer container, greeting cards are not ideally suited for inclusion with bottled gifts. This is because, the card and the bottle can become easily separated, and the only way to secure the two items together is to utilize an adhesive material such as tape. Unfortunately, whenever the card is taped onto a bottle, the resulting amalgamation is aesthetically unpleasing, and the tape itself can cause damage to the bottle label, thereby decreasing the value of the bottle.

Another popular choice is to utilize a gift bag wherein the bottle and the gift card can be placed inside the bag and presented together. Such a process is popular because it removes the need to physically adhere the card to the bottle, and provides a convenient means for carrying both items together. However, placing a bottle within a gift bag severely limits the presentation aspect of the bottle label. Moreover, the widespread use of gift bags, greeting cards and greeting card envelopes is environmentally unfriendly, as the disposal of these onetime-use items generates millions of tons of waste which ends up in landfills and oceans across the globe.

Accordingly, there remains a need for a stylized hanging gift tag which can be easily secured to a bottle without causing damage to the same, and that does not suffer from the drawbacks of the above noted devices.

SUMMARY OF THE INVENTION

The present invention is directed to a stylized hanging gift tag for attachment to bottles. One embodiment of the present invention can include a decorative main body that is adorned with indicia that includes shapes, colors, patterns and at least one celebratory message. An elongated tether can be secured to the top end of the main body and can terminate into an expandable bottle attachment loop, and a decorative chain can be disposed along the bottom portions of the main body. The device can be hung around the neck of a bottle via the expandable loop, and the chain can function to prevent the device from spinning or rotating.

Another embodiment of the present invention can include a plurality of beaded elements disposed along one or more of the chain, the tether and the loop. The beaded elements functioning to enhance the aesthetics of the device.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
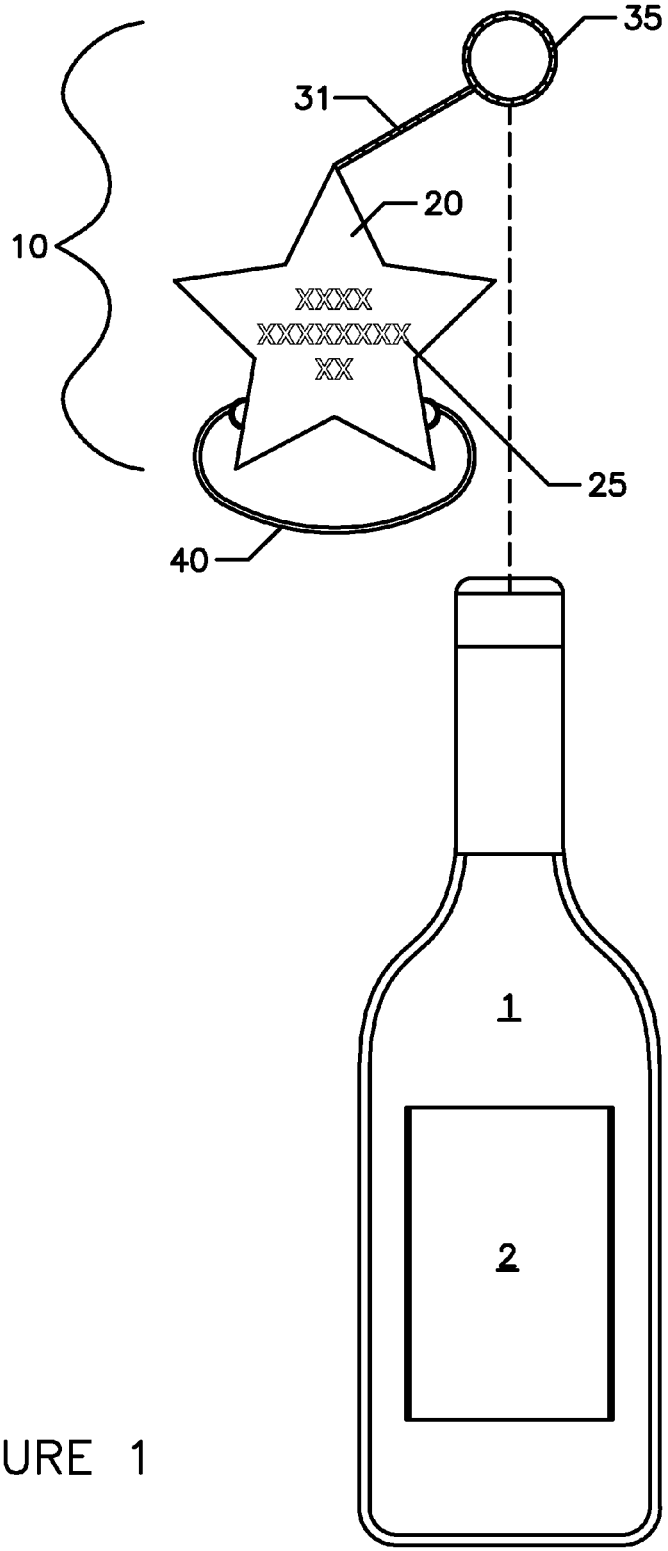
FIG. 1 is a perspective view of the stylized hanging gift tag that is useful for understanding the inventive concepts disclosed herein.
Figure 2A:
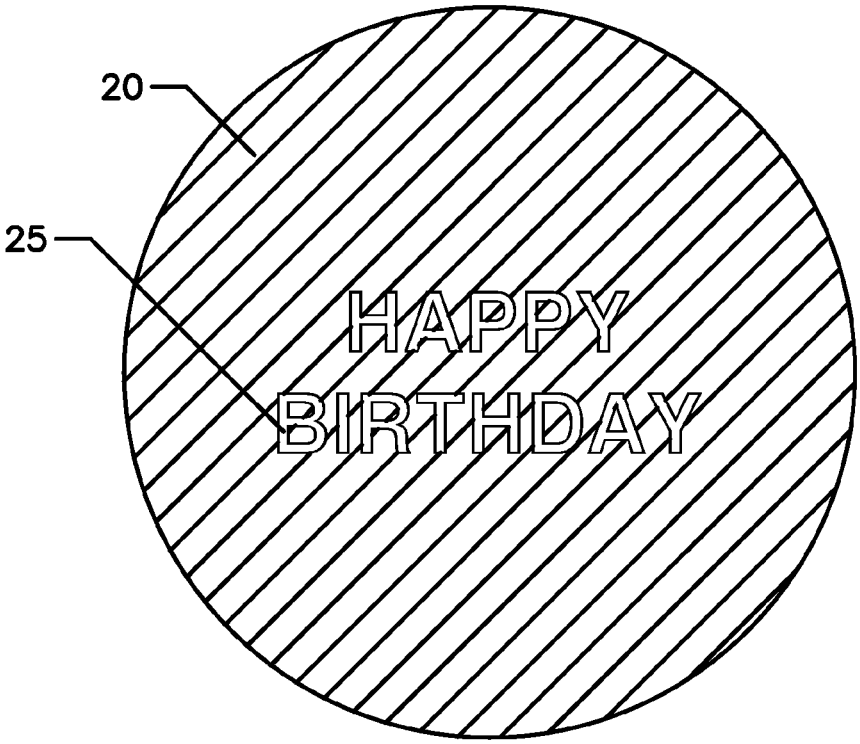
FIG. 2A is a front view of the main body of the stylized hanging gift tag in accordance with one embodiment of the invention.
Figure 2B:
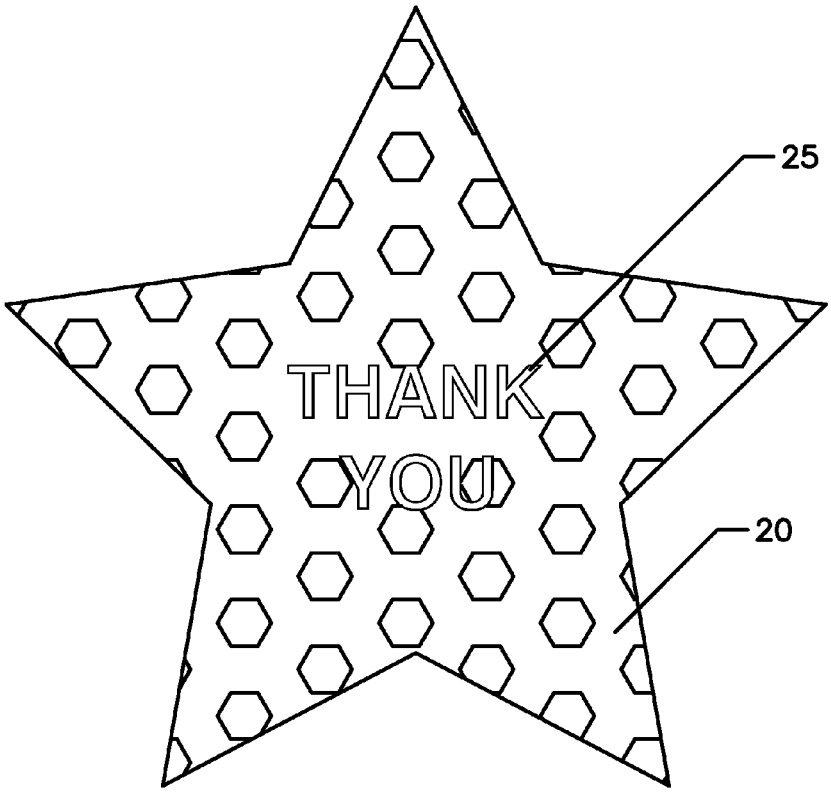
FIG. 2B is a front view of the main body of the stylized hanging gift tag in accordance with another embodiment of the invention.
Figure 2C:
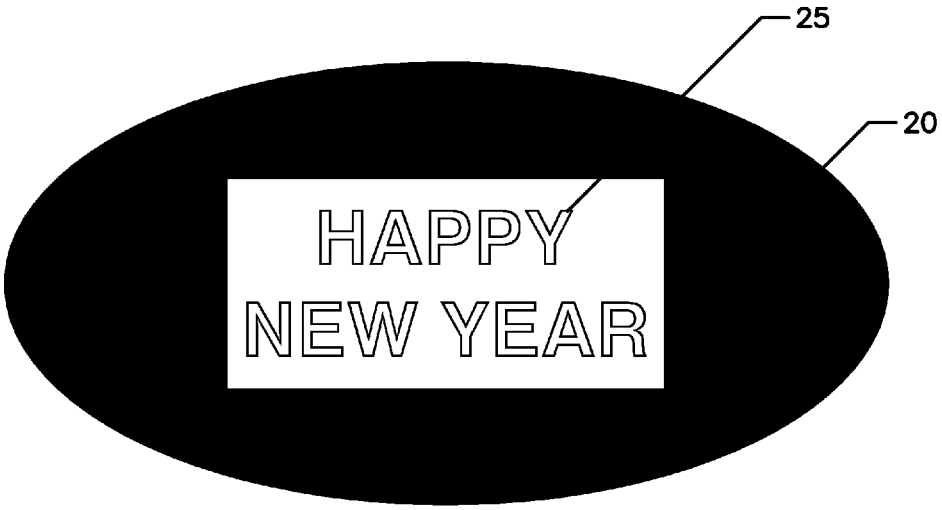
FIG. 2C is a front view of the main body of the stylized hanging gift tag in accordance with another embodiment of the invention.
Figure 2D:
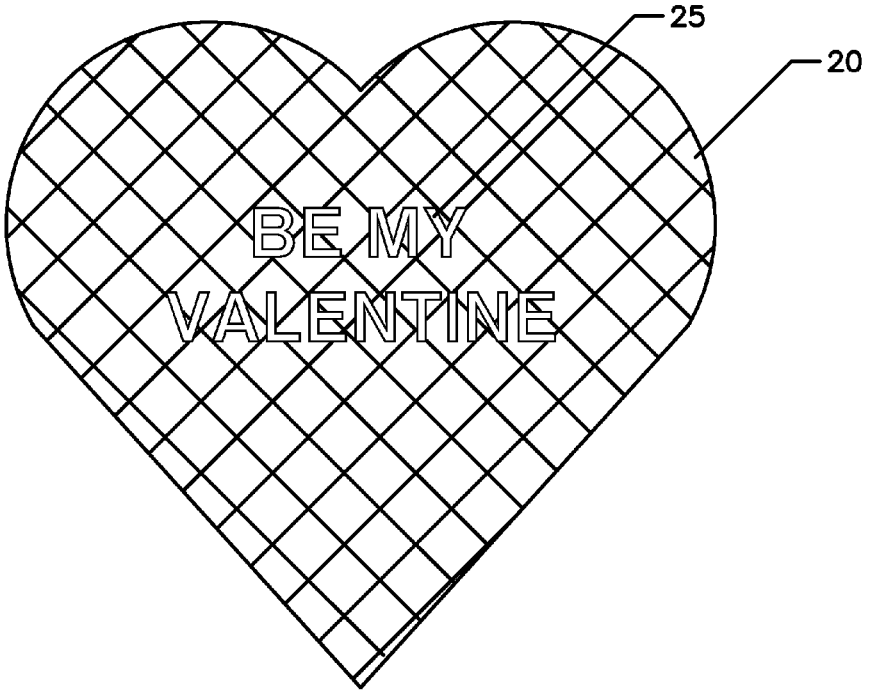
FIG. 2D is a front view of the main body of the stylized hanging gift tag in accordance with another embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

The stylized hanging gift tag described herein can be sold in retail stores that sell bottles such as alcohol, perfume, and the like which are traditionally given as gifts. Although described for use with bottles, the inventive concepts described herein are not to be construed as limiting in any manner. To this end, the below described device can be utilized with any instrument having a shape and dimension suitable for receiving the device in the manner hereinafter described.

FIG. 1 illustrates one embodiment of a stylized hanging gift tag device that is useful for understanding the inventive concepts disclosed herein. As shown, the device 10 can include, essentially, a main body 20 having a tether 31 and bottle attachment loop 35 secured along an upper portion, and a decorative chain 40 disposed along a lower portion. As shown, the device 10 can be secured to a bottle 1 having any number of decorative and/or identification labels 2.

As shown in FIGS. 2A-2D, the device 10 can include a main body 20 having any number of different shapes, sizes and construction materials. In this regard, the main body can include decorative shapes such as ovals, stars, hearts and the like. In one preferred embodiment, the main body can be constructed from a lightweight resilient and ecologically friendly material such as bioplastic, for example. Of course, any number of other suitable lightweight construction materials are also contemplated, such as lightweight metals, fabrics, composite materials and/or traditional plastics, for example. As shown, the main body 20 can take any number of different shapes and sizes and can preferably be constructed to include dimensions that are appropriate for different sized bottles so as ensure that the device 10 does not appear too big or too small for the bottle onto which it is secured. For example, the main body of the device 10 can be larger for those tags intended to be placed onto wine or champagne bottles, and the main body 20 can be smaller for those tags intended to be placed onto perfume bottles.

As further illustrated in FIGS. 2A-2D, the main body 20 can also include any number indicia 25 which can be suitable for virtually any occasion. As described herein, the term "indicia" can include any type of decorative elements such as colors, markings, words, shapes, symbols, logos, designs, lighted elements, such as inlaid LED's for example, types of materials, texturing of materials, patterns, images, lithographs and/or additional photographs, for example. In this regard, the indicia can include celebratory messages in any language, and can say things such as THANK YOU, MERRY CHRISTMAS, MAZEL, and HAPPY BIRTHDAY, among many others, for example.

The indicia 25 can be provided onto the main body in accordance with any known technique and can be imprinted thereon, inlaid onto the main body 20 or can be provided as a raised/protruding element that radiates outward from the main body 20, so as to give a three dimensional effect.

Figure 3:
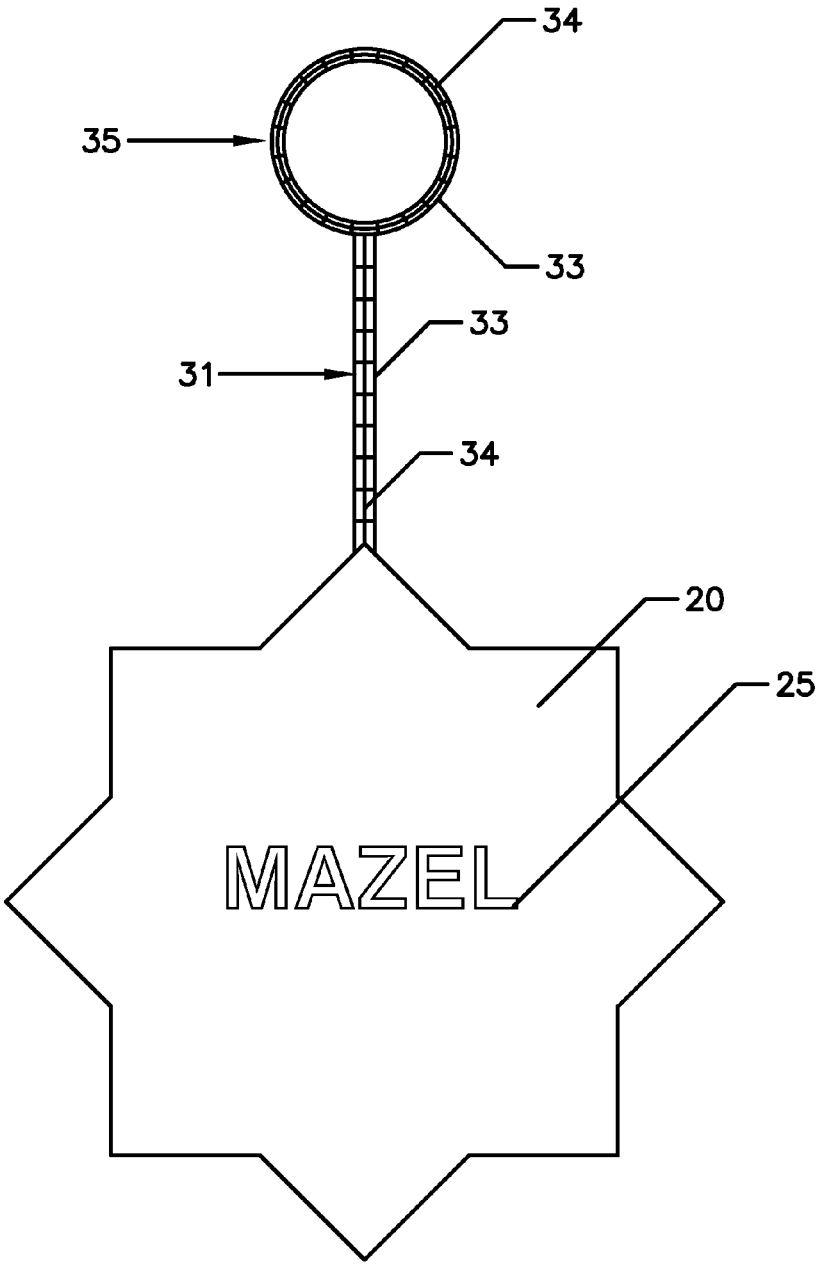
FIG. 3 is a front view of the main body, tether and attachment loop of the stylized hanging gift tag in accordance with one embodiment of the invention.

As shown in FIG. 3, an elongated tether 31 can be secured along the upper portion of the main body, and can terminate into an expandable loop section 35. In one preferred embodiment, the tether and loop can include a unitary construction having an elastic core member 33 that is surrounded by a plurality of decorative beads 34 and/or bejeweled elements. As shown best in FIG. 4, the loop section 35 can expand (see arrow A) in order to accommodate a wide variety of bottle neck sizes.

Figure 4:
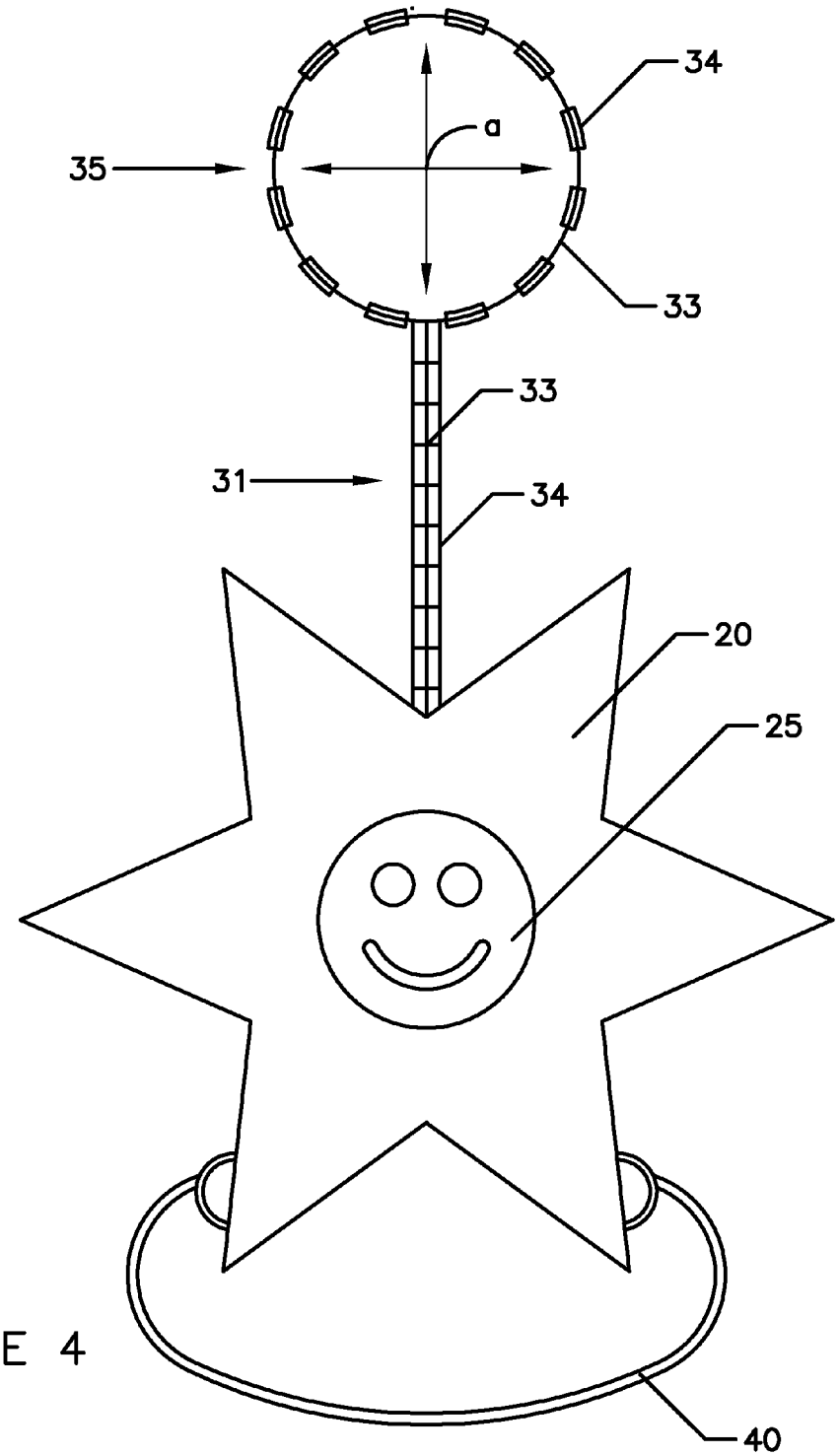
FIG. 4 is a front view of the stylized hanging gift tag in accordance with one embodiment of the invention.

FIG. 4 illustrates another embodiment of the hanging gift tag device 10 that further includes a decorative chain 40, which can be connected to the sides of the main body 20 and extend across the back section thereof. In this manner, the chain 40 can function to loop around the bottle 1 in order to prevent the device 10 from spinning and/or rotating when secured to the bottle. Such a feature can function to ensure that the indicia 25 of the main body 20 always faces the desired direction.

Although described above as including a plurality of decorative beads, other embodiments are also contemplated. For example, the elastic core can include a coating so as to give the illusion that it is metal. Additionally, each of the tether, loop section and decorative chain can be secured together or onto the main body utilizing any number of known techniques such as adhesives, or via a plurality of openings through which the elements are securely tied. Moreover, although described above as a chain, element 40 can be constructed from any number of different materials thereby forming a rope or string element suitable for functioning as described above.

Figure 5:
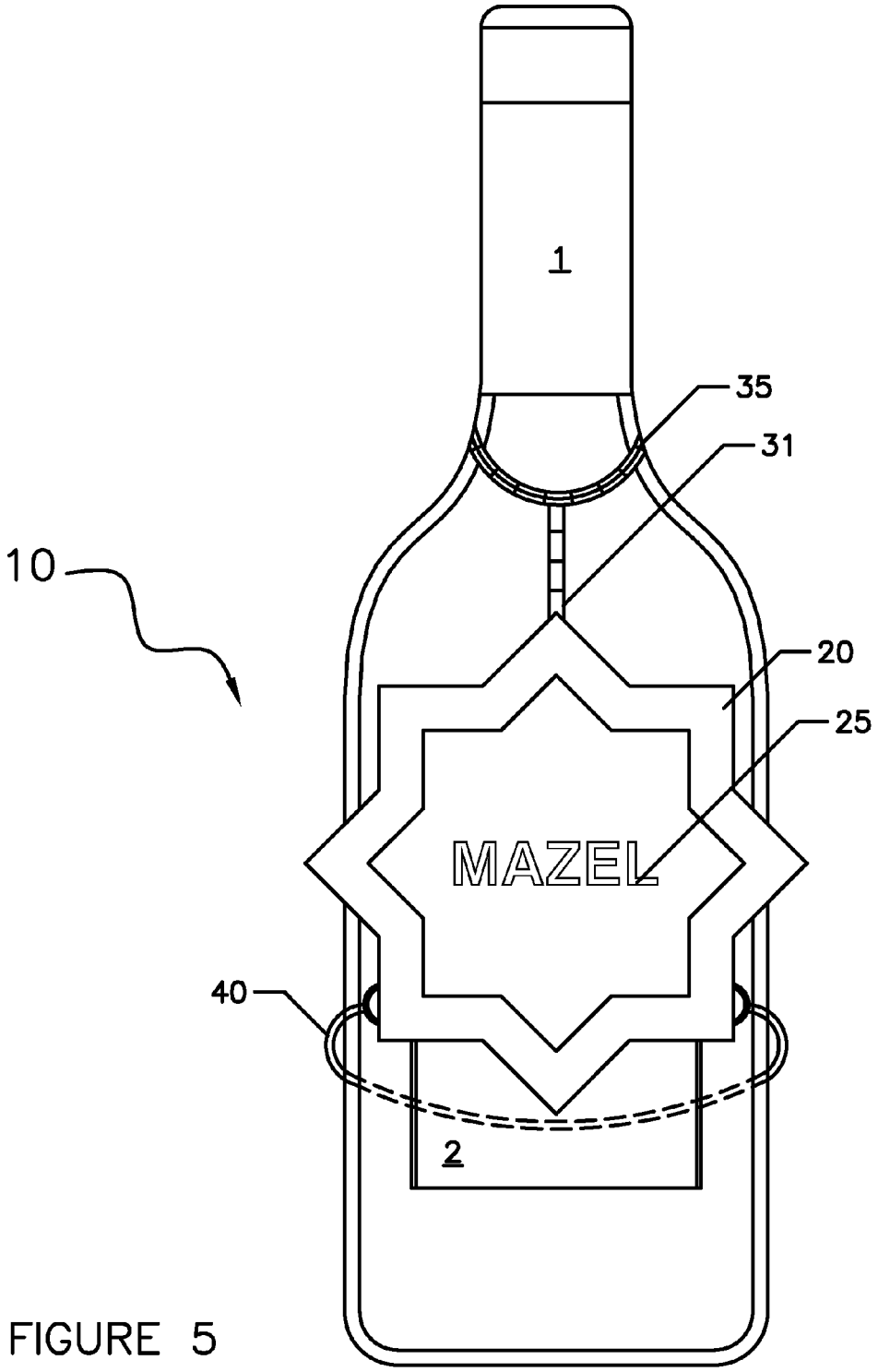
FIG. 5 is a front view of the stylized hanging gift tag in operation, in accordance with one embodiment of the invention.

As shown in FIG. 5, once positioned onto a conventional bottle, the hanging gift tag device 10 functions to adorn the same with any number of indicia and/or celebratory messages in a manner that does not damage or otherwise detract from the natural aesthetics of the bottle itself.

Although described above as including construction materials such as plastic, beads and elastic, the inventive concepts described herein can be incorporated into an extremely high end gift tag. In this regard, one embodiment of the device 10 can include a main body that is constructed from, or lined with precious metal such as gold or platinum, for example; one or more of the chain 40, tether 31 and loop 35 can be constructed from gold or silver, and a plurality of precious or semiprecious stones can function as the decorative beads 34. Such features being appropriate for adornment onto rare or expensive bottles, for example.

As described herein, one or more elements of the hanging gift tag device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A gift tag device, comprising:

a lightweight main body having a front facing surface, a rear facing surface, a top end, a bottom end, and a pair of opposing sides;

one or more indicia disposed along the front facing surface of the main body;

an elastomeric attachment loop having a dimension suitable for engaging a neck of a bottle;

an elongated tether having a first end that is connected to the main body, and a second end that is connected to the attachment loop; and a chain having a first end that is in communication with one of the opposing sides of the main body, and a second end that is in communication with the other opposing side of the main body, said chain consisting of an elongated single member having a dimension that is suitable for engaging a lower body portion of the bottle, and functioning to prevent a spinning and a rotating movement of the main body.

2. The device of claim 1, wherein the main body includes a decorative shape.

3. The device of claim 1, wherein the main body is shaped as at least one of a heart, and a star.

4. The device of claim 1, wherein the indicia includes a plurality of decorative elements.

5. The device of claim 1, wherein the indicia includes at least one celebratory message.

6. The device of claim 5, wherein the celebratory message is imprinted onto the main body.

7. The device of claim 5, wherein the celebratory message is inlaid onto the front surface of the main body.

8. The device of claim 5, wherein the celebratory message is provided in raised letters on the front surface of the main body.

9. The device of claim 1, further comprising:

a plurality of decorative beads disposed along one or more of the elongated tether and attachment loop.

10. The device of claim 1, wherein the main body is constructed from at least one of gold and platinum, at least one of the chain, tether and attachment loop are constructed from at least one of gold and silver.

11. The device of claim 10, further comprising:

one or more precious or semiprecious jewels that are disposed onto at least one of the main body, the chain, the tether and the attachment loop.

* * * * *